US006130408A

United States Patent [19]

Fukuda et al.

[11] Patent Number: 6,130,408

[45] Date of Patent: Oct. 10, 2000

[54] RECORDING APPARATUS WITH CONVEYED RECORDING SHEET HEATED BY MOVABLE HEATER

[75] Inventors: Hiromitsu Fukuda; Hidefumi Ohtsuka; Chikara Hiraoka, all of Ibaraki-ken; Shuho Yokokawa, Mito; Isao Nakajima, Hitachinaka; Yoji Hirose, Mito; Akihiko Yamazaki, Hitachinaka, all of Japan

[73] Assignees: Hitachi, Ltd.; Hitachi Koki Co., Ltd., both of Tokyo, Japan

[21] Appl. No.: 09/018,346

[22] Filed: Feb. 4, 1998

[30] Foreign Application Priority Data

Feb. 14, 1997 [JP] Japan ..... 9-030554

[51] Int. Cl.[7] ..... G03G 15/20

[52] U.S. Cl. ..... 219/216; 219/388; 392/417; 399/337; 432/229

[58] Field of Search ..... 219/216, 388; 399/335, 337, 336; 355/27; 347/55; 432/229; 99/386, 443 C; 392/417; 34/266, 273, 274

[56] References Cited

U.S. PATENT DOCUMENTS

| | | | |
|---|---|---|---|
| 3,166,304 | 1/1965 | Alexeff | 432/229 |
| 3,290,026 | 12/1966 | Alexeff | 432/229 |
| 4,034,186 | 7/1977 | Bestenreiner et al. | 219/216 |
| 4,228,345 | 10/1980 | Stricker et al. | 219/388 |
| 4,326,910 | 4/1982 | Davis | 156/583.5 |
| 4,386,840 | 6/1983 | Garthwaite et al. | 399/337 |
| 4,408,400 | 10/1983 | Colapinto | 34/278 |
| 4,428,563 | 1/1984 | Cunningham et al. | 266/113 |
| 4,619,050 | 10/1986 | Klemm | 34/278 |
| 4,745,432 | 5/1988 | Langdon | 355/3 |
| 4,799,085 | 1/1989 | Nagumo et al. | 355/27 |
| 4,946,756 | 8/1990 | Estavoyer et al. | 219/216 |
| 5,113,223 | 5/1992 | Theodoulou et al. | 219/220 |
| 5,258,256 | 11/1993 | Aslam et al. . | |
| 5,319,429 | 6/1994 | Fukuchi et al. | 355/290 |
| 5,353,572 | 10/1994 | Shigeta | 53/371.5 |
| 5,465,146 | 11/1995 | Higashi et al. | 399/328 |
| 5,471,924 | 12/1995 | Helling | 101/424.1 |
| 5,714,736 | 2/1998 | Yoneda et al. | 219/216 |
| 5,774,763 | 6/1998 | Muramatsu | 399/336 |
| 5,784,679 | 7/1998 | Schlueter, Jr. et al. | 399/335 |
| 5,801,729 | 9/1998 | Kitamura | 347/55 |

FOREIGN PATENT DOCUMENTS

| | | |
|---|---|---|
| 44 07 931 | 1/1996 | Germany . |
| 49-75144 | 7/1974 | Japan . |
| 50-129038 | 10/1975 | Japan . |
| 5-11651 | 1/1993 | Japan . |
| 7-287460 | 10/1995 | Japan . |
| 633804 | 12/1949 | United Kingdom . |
| 92/06417 | 4/1992 | WIPO . |

*Primary Examiner*—John A. Jeffery
*Attorney, Agent, or Firm*—Antonelli, Terry, Stout & Kraus, LLP

[57] ABSTRACT

A heating belt is laid along a conveying path for a recording medium moved after development, a halogen lamp is incorporated in a belt drive roller for driving the heating belt so as to heat the heating belt by heat generated by the halogen lamp, and accordingly, the heating belt whose temperature is controlled at a predetermined temperature heats the recording sheet. With this arrangement, the conveying speed of the recording sheet and the moving speed of the heating belt are set to be equal to each other. Alternatively, the heating belt may itself generate heat.

6 Claims, 10 Drawing Sheets

RECORDING APPARATUS WITH CONVEYED RECORDING SHEET HEATED BY MOVABLE HEATER

BACKGROUND OF THE INVENTION

The present invention relates to a heating device for heating a medium to be heated on moving, and in particular to a heating device adapted to be used for fusing and fixing toner on a recording sheet conveyed at an arbitrary speed in a noncontact condition within a fixing part, for example, in an electrophotographic recording apparatus, or for preheating a recording sheet in a noncontact condition before fixing.

Conventionally, for example, Japanese Laid-Open Patent No. 49-75144 discloses a heating device comprising a radiator for generating radiation energy for fusing toner on a recording sheet, and a reflector or a cover having a mirror surface covering the radiator, for preventing the radiation energy from leaking therearound.

Further, Japanese Laid-Open Patent No. 50-129038 discloses a heating device having a band-like heating element and a reflector arranged at the rear surface of the former, for heating a recording sheet over a wide range.

SUMMARY OF THE INVENTION

In any of the above-mentioned conventional heating devices, a toner to be fused or a recording sheet to be preheated, is moved at a predetermined speed while the radiator or the band-like heating element is fixed so as to be stationary. This arrangement cannot sufficiently apply thermal energy having a sufficiently high heating value necessary for fusing toner and heating the recording sheet if the recording sheet or the toner is moved at a high speed although thermal energy can be applied to the toner or the recording sheet even with a low degree of efficiency if the toner or the recording sheet is moved at a low speed or is stopped. Should thermal energy having a high heating value be applied, the temperature of a heat source would become higher so that a high heating energy should be required. Further, this heating device has to have a mechanism for preventing a recording sheet from burning, or to incorporate a large scale safety measure or the like.

The present invention has been devised in order to heat opposite surfaces of a medium to be heated on moving in a noncontact condition, and more specifically, to heat the opposite surface of a recording medium on moving at a high rate in a noncontact condition so as to fix toner on the recording sheet.

DESCRIPTION OF THE PREFERRED EMBODIMENTS

Explanation will be hereinbelow made of preferred embodiments of the present invention.

Figure 1:
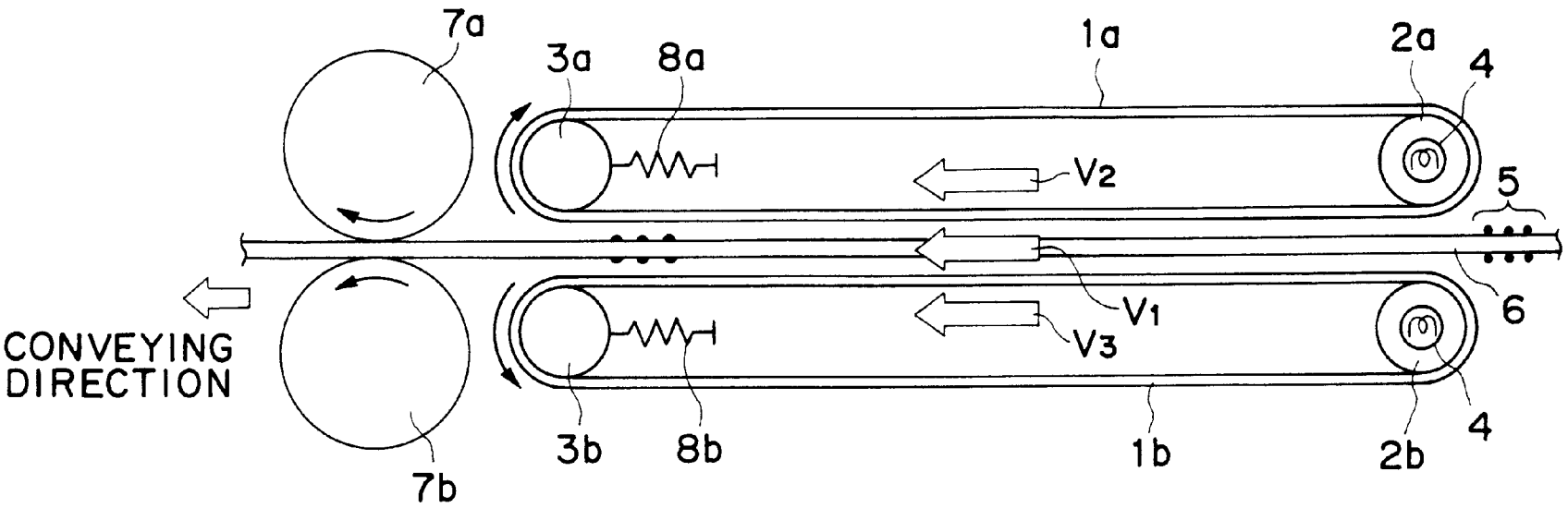
FIG. 1 is a schematic side view illustrating an embodiment of a heating device according to the present invention.

Referring to FIG. 1 which is a side view illustrating a heating device in a first embodiment, the heating device is arranged along a conveying path for a recording sheet 6 to which unfixed toner sticks and which is conveyed by a recording sheet conveying roller 7*a* (7*b*) pressed against the recording sheet. The heating device as shown, comprises a belt drive roller 2*a* (2*b*) serving as a member for holding a heating means, having rotary shafts laid orthogonal to a direction of conveying a recording sheet 6 to be heated, and rotatably arranged in parallel with the surface of the recording sheet 6, an idler roller 3*a* (3*b*) having rotary shaft which is parallel with the rotary shaft of the belt drive roller 2*a* (2*b*) having an outer peripheral surface defining a gap with respect to the recording sheet 6, which is set to be equal to the gap between the outer peripheral surface of the belt drive roller 2*a* (2*b*) and the recording sheet 6, an endless belt 1*a* (1*b*) serving as heating means, wound around and stretched between the belt drive roller 2*a* (2*b*) and the idler roller 3*a* (3*b*), a tension spring 8*a* (8*b*) for urging the idler roller 3*a* (3*b*) to go away from the belt drive roller 2*a* (2*b*) for applying a tension to the endless belt 1*a* (1*b*), a halogen lamp 4 provided in the belt drive roller 2*a* (2*b*) and serving as a heat source, and a control means, which is not shown, for controlling a drive source for rotating the belt drive roller 2*a* (2*b*) and for controlling the turn-on and off of the halogen lamp 4. The belt drive roller 2*a* (2*b*) is driven so that the heating belt 1*a* (1*b*) is moved in the direction of conveying the recording sheet 6 on the side near to the recording sheet 6.

A subscript a attached to each of reference numerals denoting components, indicates that the associated component is arranged on one side of the surface of the recording sheet 6 on the conveying path therefor, and a subscript b attached to each of reference numerals denoting components, indicates the associated component is arranged on the other side of the surface of the recording sheet 6. That is, in this embodiment, the heating devices having an identical arrangement are laid, symmetric with each other, on opposite sides of the conveying path for the recording sheet 6 (opposite sides of the surface of the recording sheet 6).

The gap between the surface of the heating belt 1*a* (1*b*) which faces the recording sheet 6 to be conveyed, and the recording sheet 6 is set to a small value such as about 2 mm so that air between the heating belt 1*a* (1*b*) and the recording sheet 6 is carried by the heating belt 1*a* (1*b*) or the recording sheet 6 in the direction in which the heating belt 1*a* and the recording sheet 6 are moved, due to a frictional force produced between the air and the heating belt 1*a* (1*b*) or the recording sheet 6. It is noted that the concavities and convexities may be formed on the outer surface of the heating belt 1*a* (1*b*) so as to surely carry the air between the heating belt 1*a* (1*b*) and the recording sheet 6.

The heating belt 1*a* (1*b*) is held, being subjected to tension by the tension spring 8 through the belt drive roller 2*a* (2*b*) and the idler roller 3*a* (3*b*). The conveying speed of the heating belt 1*a* (1*b*) can be set by controlling the rotational speed of the belt drive roller 2*a* (2*b*). Further, the temperature of the heating belt 1*a* (1*b*) can be held around a set value by turning on and off the halogen lamp 4 provided in the belt drive roller 2*a* (2*b*).

Figure 2:
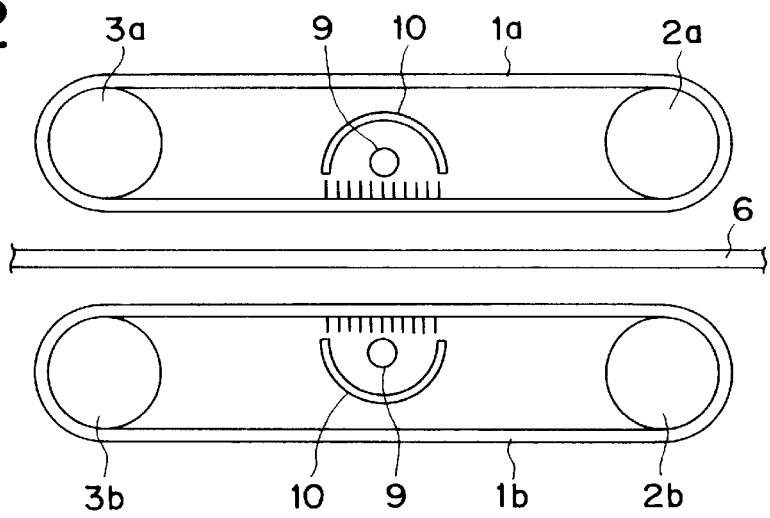
FIG. 2 is a schematic side view showing a method of heating a heating belt in another example of the heating device according to the present invention.

Although the embodiment in which the halogen lamp 4 serving as a heat source is provided in the belt drive roller 2*a* (2*b*), is shown in FIG. 1, such an arrangement that the heating belt 1*a* (1*b*) itself generates heat may be used. As to the arrangement in which the heating belt 1*a* (1*b*) itself generates heat, there may be used an arrangement in which induction current is generated in a metal heating belt so as to produce resistive heat, or an arrangement in which a conductor for producing resistive heat embedded in the heating belt is fed with an electric power through slidable contacts. Further, as shown in FIG. 2, a heating element 9 and a reflector 10 are provided at the rear surface of the heating belt 1*a* (1*b*), near to the recording sheet 6 so that the heating belt 1*a* (1*b*) is heated by heat from the heating element 9 while the heating value of the heating element 9 is controlled so as to control the temperature of the heating belt 1*a* (1*b*).

With this arrangement, the heating belt 1*a* (1*b*) held at a set temperature can be moved at an arbitrary speed V2 (V3). The basic conceptional arrangement according to the present invention is adapted to carry out double-surface image recording. In this arrangement, since unfixed toner sticks to both front and rear surfaces of the recording sheet 6, the heating means having identical structures are laid facing the front and rear surfaces of the recording sheet 6. In the case of single-surface image recording, since the toner 5 sticks to one of the opposite surfaces of the recording sheet 6, the heating belt is made in contact with the surface of the recording sheet 6 to which no toner 5 sticks in order to efficiently heat the recording sheet 6 for fusing the toner 5.

In another system for recording on a single surface, it is considered that a heating belt is laid at a surface of the recording sheet to which toner sticks so as to fuse the toner 5 in a contact or noncontact manner. As to the conveyance of the recording sheet 6, the recording sheet 6 can be conveyed at an arbitrary speed V1 by the recording sheet conveying rollers 7*a*, 7*b* with which the recording sheet 6 is made into press-contact.

In this embodiment, the conveying speed of the recording sheet 6 and the moving speeds of the heating belts 1*a*, 1*b*can be controlled, independent from one another. That is, the conveying speeds are set so as V1=V2=V3, where V1 is a conveying speed of the recording sheet 6, V2 is a moving (conveying) speed of the heating belt 1*a*, and V3 is a moving (conveying) speed of the heating belt 1*b*. Further, the gap between the heating belt 1*a* (1*b*) and the recording sheet 6 to be conveyed is preferably set to be as small as possible within a range in which the heating belt 1*a* (1*b*) can be prevented from making contact with the recording sheet 6 to be conveyed.

By reducing the gap, air between the heating belt 1*a* (1*b*) and the recording sheet 6 can be moved together with the heating belt 1*a* (1*b*) and the recording sheet 6 due to frictional force between the air and the recording sheet 6. Accordingly, the recording sheet 6 is heated not only by radiant heat from the heating belt 1*a* (1*b*), but also and by the heated air which is held between the recording sheet 6 and the heating belt 1*a* (1*b*). This arrangement can improve the thermal efficiency by several times in comparison with an oven system in which heating means is stationary (V2=V3=0). In the case of the recording on double surfaces, the speeds V1, V2, V3 are set so as V1=V2 (V3).

Next, explanation will be made of the heating efficiency in the present invention with reference to FIGS. 3(*a*) and 3(*b*) and FIG. 4.

Figure 3A:
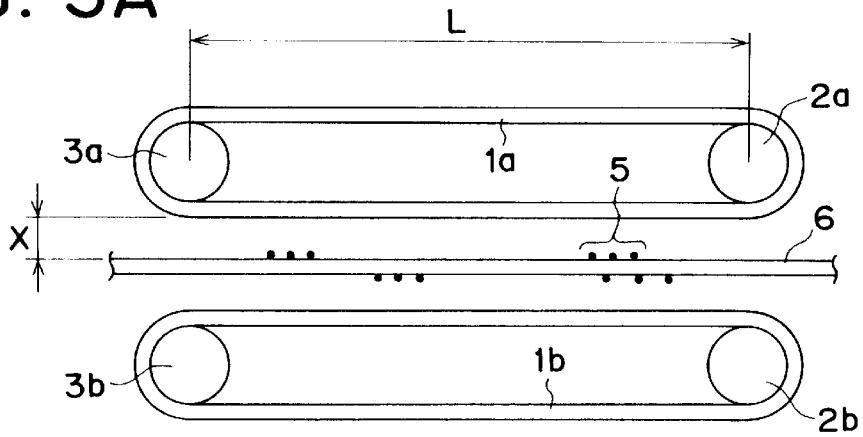
FIGS. 3*a* and 3*b* are schematic side views illustrating heat lengths of the embodiment and a conventional heating device, respectively.
Figure 3B:
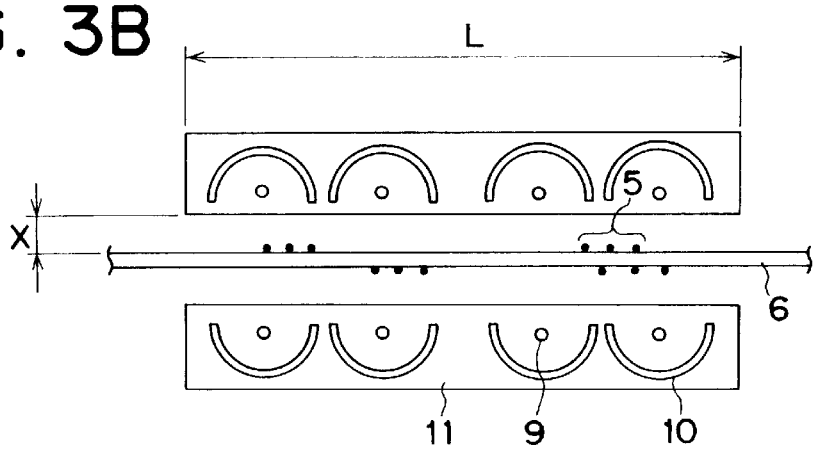

Referring to FIG. 3*a* which schematically shows the heating device in this embodiment, the center-to-center distance between the belt drive roller 2*a* (2*b*) and the idler roller 3*a* (3*b*) is taken as a heating length L, and the gap between the front surface of the recording sheet 6 and the heating belt 1*a* is set to X (the gap between the rear surface of the recording sheet 6 and the heating belt 1*b* is also set to X). Meanwhile, referring to FIG. 3*b* which schematically shows an oven type heating device, the distance between the opposite ends of a cover 11 is taken as a heating length L, and the gap between the front surface of the recording sheet 6 and an end part of the cover 11 which is near to the surface of the recording sheet 6 is set to X (the gap as to the rear surface of the recording sheet 6 is also set to X). The oven system has in general such an arrangement that a reflector 10 is laid on the rear side of each heating element 9 in order to direct heat generated from the heating element 9 onto the recording sheet 6 and the toner 5 as shown in the figure.

Figure 4:
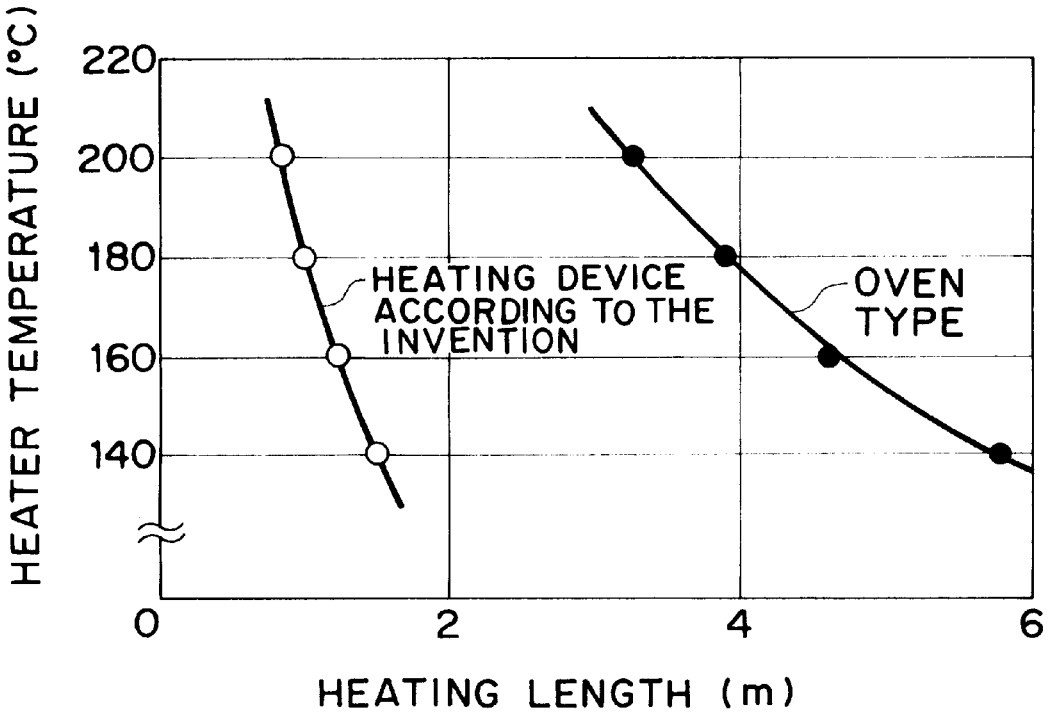
FIG. 4 is a graph showing results of thermal calculation for comparing relationships between a heating length required for fusing toner on toner on a recording sheet, and a heater temperature.

FIG. 4 shows a relationship between the heating length L required for fusing the toner 5 on the recording sheet 6, and the temperature of the heater, being obtained from results of calculation in such a case that the gap X is set so as X=2 mm. The heater temperatures are obtained from the temperature of the front surface of the heating belt 1*a* (1*b*), and from the temperature of the heating element 9. Referring to FIG. 4, if the recording sheet 6 is heated by the same heater temperature, in the heating device in this embodiment, the heating length L can be set to a value which is about one-third of that of the oven type heating device. That is, by setting as V1=V2 V3, the heating efficiency becomes higher than that of the case in which V2=V3=0 is set.

Explanation will be made of a second embodiment of the present invention with reference to FIGS. 5 and 6.

Figure 5:
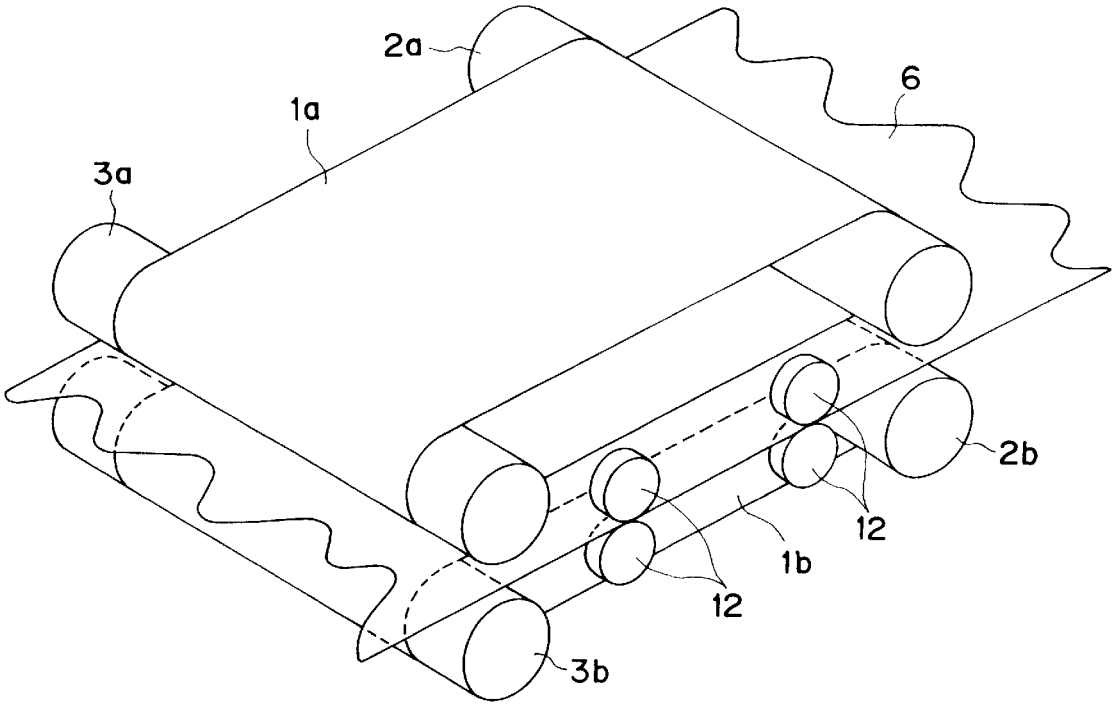
FIG. 5 is a perspective view illustrating a second embodiment.
Figure 6:
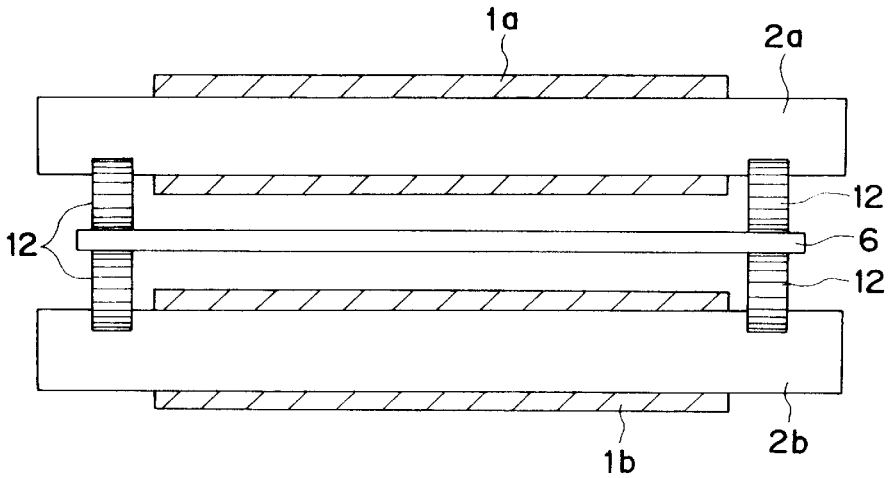
FIG. 6 is a sectional view illustrating the second embodiment in front thereof in a conveying direction of a recording sheet.

Referring to FIG. 5 which shows such an arrangement that a recording sheet conveying rolls 12 are added in the arrangement of the first embodiment. This recording sheet conveying rolls 12 are adapted to prevent the recording sheet 6 and the toner 5 from making contact with the heating belts 1*a*, 1*b*. As shown in FIG. 6 which is a sectional view as viewed from the front in the conveying direction, the opposite end parts of the recording sheet 6 where no toner sticks are held being pressed against the recording sheet conveying rolls 12, so as to restrain vibration in a direction orthogonal to the conveying direction of the recording sheet 6 in order to maintain the gap between the heating belts 1*a*, 1*b* and the recording sheet 6 or the toner 5 at a constant value. Actually, the thickness of the layer of the toner 5 is less than 0.1 mm, and accordingly, it is sufficient to consider the gap obtained between the heating belts 1*a*, 1*b* and the recording sheet 6. Further, a drive force may be given by these recording sheet conveying rolls 12 so as to convey the recording sheet 6. In this embodiment, even though the gap between the surface of the recording sheet 6 to be conveyed and the heating belts 1*a*, 1*b* is narrowed, the surface of the recording sheet 6 and the heating belts 1*a*, 1*b* can be prevented from making contact with each other since the recording sheet 6 is restrained from flattering, thereby it is possible to prevent the image quality from being lowered caused by deviation of the toner.

Next, explanation will be made of a third embodiment of the present invention with reference to FIGS. 7 and 8.

Figure 7:
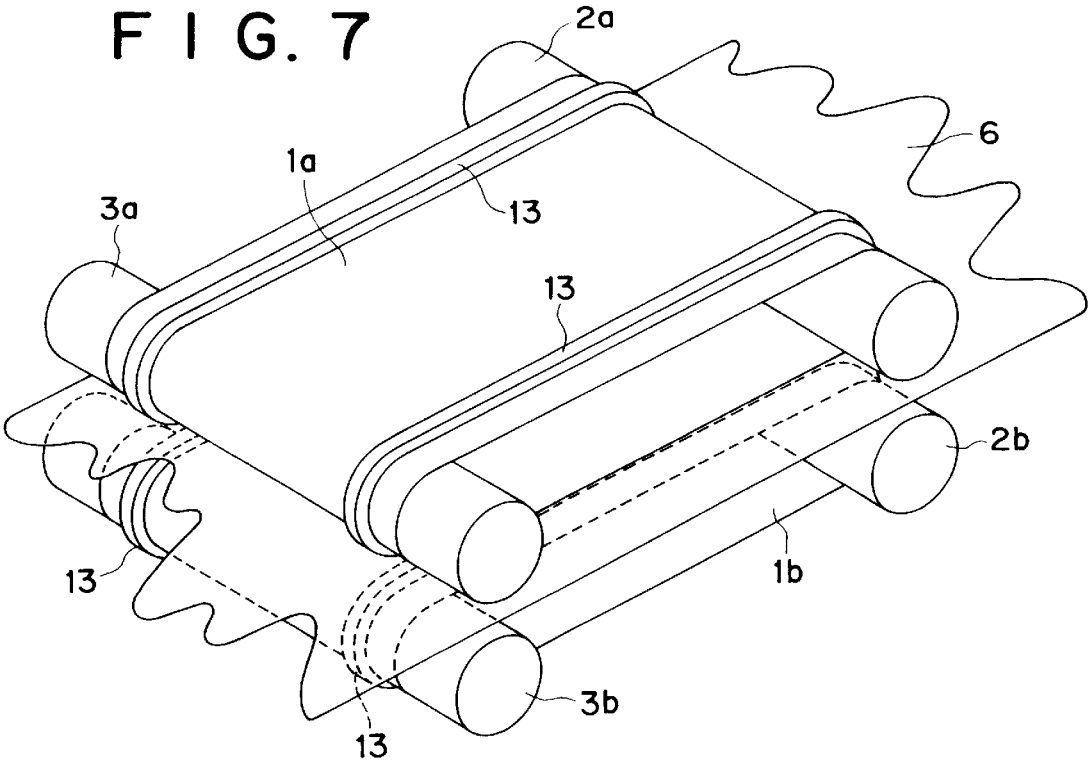
FIG. 7 is a perspective view illustrating a third embodiment of the present invention.
Figure 8:
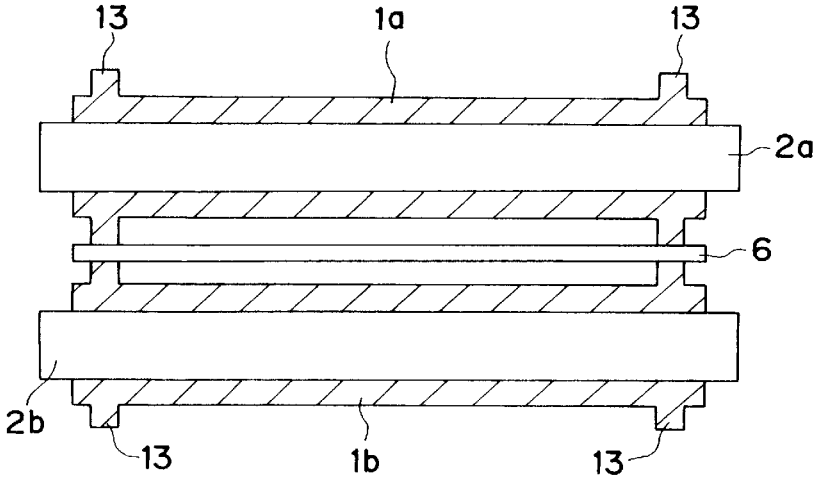
FIG. 8 is a sectional view illustrating the third embodiment in front thereof in a conveying direction of a recording sheet.

FIG. 7 shows such an arrangement that the recording sheet 6 is held and conveyed by recording sheet conveying ribs 13 provided at widthwise opposite end parts of the heating belts 1*a*, 1*b* on the sides facing the recording sheet 6. The recording sheet conveying ribs 13 are made of an elastic material such as silicon rubber, and are bonded to the heating belts 1*a*, 1*b* so as to be integrally incorporated with the latter. With this arrangement, the conveying forces of the heating belts are transmitted to the recording sheet 6 so that the heating belts 1*a*, 1*b* and the recording sheet 6 can be moved at the same speed. Further, as shown FIG. 8 which is a sectional view in the front as viewed in the direction of the conveyance, the height of the recording sheet conveying ribs 13 can maintain the gap between the heating belts 1*a*, 1*b* and the recording sheet 6 at a constant value. In this embodiment, even though the gap between surface of the recording sheet and the heating belts 1*a*, 1*b* is narrowed, the gap between the recording sheet 6 and the heating belts 1*a*, 1*b* can be ensured so as to prevent the recording sheet 6 and the heating belts 1*a*, 1*b* from making contact with each other, thereby it is possible to prevent the image quality from being lowered due to deviation of the toner.

In the above-mentioned embodiments, the arrangements in which the recording sheet 6, the toner 5 and the heating belts 1*a*, 1*b* are not made into contact with one another, have been explained. Next explanation will be hereinbelow made of a structure of the heating belt in which they make contact with one another for heating.

Figure 9:
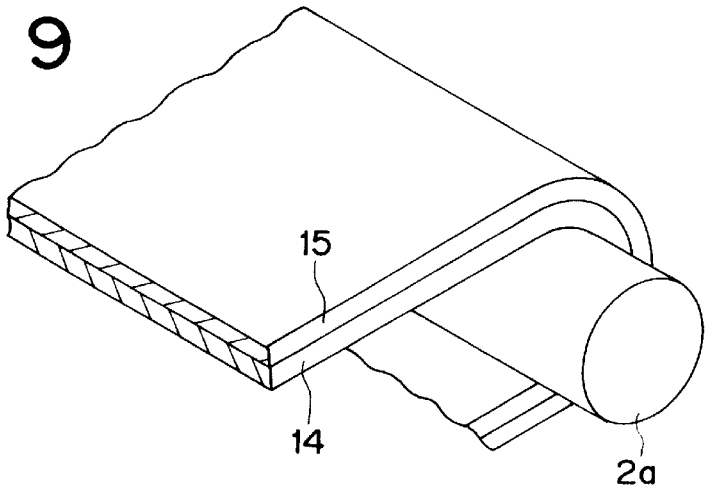
FIG. 9 is a sectional view illustrating an example of a structure of a heating belt.

Referring to FIG. 9 which is a sectional view illustrating the structure of the heating belts 1*a* or 1*b*, a surface lubricating member is applied over the outer surface of a base member made of a metal material 14 which is nickel, stainless or the like. The surface lubricating member 15 is coated thereover with resin, rubber or the like of a fluorine or silicon group. With this arrangement, the fused toner can hardly stick to the heating belt when the latter makes into contact with the fused toner. Further, a bias voltage is applied to the heating belts 1*a*, 1*b*, it is possible to obtain such an arrangement that the toner can hardly stick to the heating belts 1*a*, 1*b* in an electric manner. In this embodiment, the conveying speeds of the heating belts 1*a*, 1*b* and the recording sheet 5 are set to be equal to one another, and accordingly, no rubbing caused by a difference in speed therebetween occurs, it is possible to prevent deterioration of the image quality.

Next, explanation will be made of the arrangement of a double surface image recording apparatus using the heating device according to the present invention with reference to FIGS. 10, 11, 12 and 13.

Figure 10:
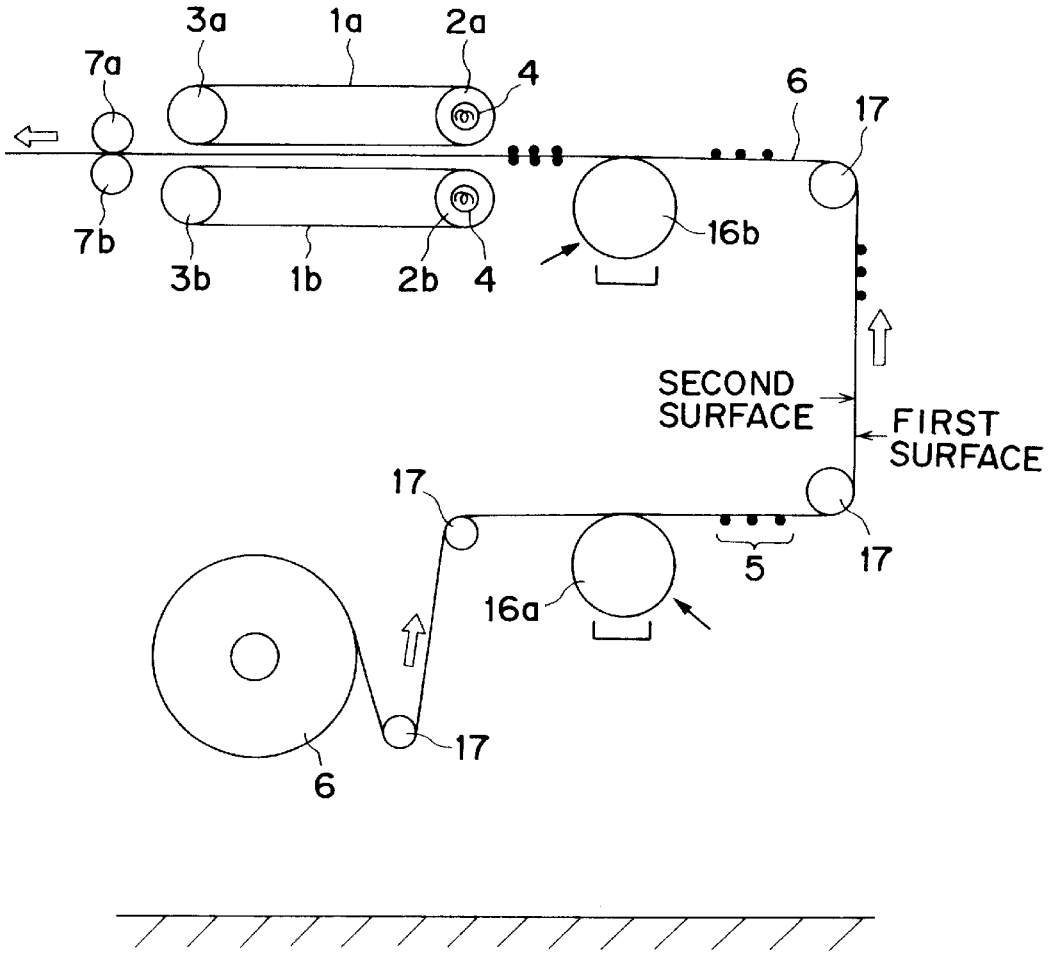
FIG. 10 is a schematic side view illustrating a recording apparatus using the heating device according to the present invention.

Referring to FIG. 10 which shows the double surface image recording apparatus using the heating device according to the present invention, the apparatus is composed of a plurality of guide rollers 17 arranged along a conveying path for the recording sheet 6 fed from a rolled stack, a developing and image-transferring mechanism 16*a* laid on one side (the first surface side of the recording sheet) of the conveying path defined by the guide rollers 17, a developing and image-transferring mechanism 16*b* laid on the other side (the second surface side of the recording sheet) of the conveying path, downstream of the developing and image-transferring mechanism 16*a*, heating devices which are arranged, symmetric with each other on opposite sides (the first and second surface sides of the recording sheet) of the conveying path, downstream of the developing and image-transferring mechanism 16*b*, and recording sheet conveying rollers 7*a*, 7*b* arranged downstream of the developing and image-transferring mechanism 16*b*, for conveying the recording sheet.

Rotary shafts of the guide rollers 17, those in the developing and image-transferring mechanisms 16*a*, 16*b*, those in the heating devices, and those of the recording sheet conveying rollers 7*a*, 7*b* are all laid in parallel with one another so as to be horizontal in a condition they re installed in the recording apparatus. Further, the recording sheet 6 is conveyed in a substantially horizontal posture in a part held between the heating devices. Further, the heating devices which are laid, symmetric with each other on the opposite sides (the first and second surface sides of the recording sheet) of the conveying path down stream of the developing and image-transferring mechanism 16*b*, may be any one of those explained in the first to third embodiments as mentioned above.

The recording sheet 6 fed from the rolled stack, is conveyed along the conveying path defined by the plurality of guide rollers 17, and an image is formed on the first surface side of the recording sheet 6 by the developing and image-transferring mechanism 16*a*. At this time, the toner 5 on the first surface side of the recording sheet has not yet been fixed, that is, the unfixed toner 5 is conveyed to the next process station. Next, an image is formed on the second surface side of the recording sheet 6, similar to the first surface side, by the developing and image-transferring mechanism 16*b*. Thus, the unfixed toner images formed on both surfaces of the recording sheet 6 are conveyed toward the heating devices, which fix the images. That is, the toner 5 on both surfaces of the recording sheet 6 is heated respectively by the heating belts 1*a*, 1*b* facing each other so as to complete the fixing thereof. The conveyance of the recording sheet 6 is effected by the recording sheet conveying rollers 7*a*, 7*b* arranged at the downstream end of the recording sheet conveying path. After completion of the development and image-transfer of the second side surface of the recording sheet 6, no contact can be made with the recording sheet 6 since the toner on both surfaces thereof has not yet been fixed. Accordingly, the recording sheet conveying path after the image-transfer is carried out on the second surface side of the recording sheet in this embodiment, is preferably a straight path up to the recording sheet conveying rollers 7*a*, 7*b* without being curved by the guide rollers 17. As mentioned above, the conveying speeds of the recording sheet 6 and the heating belts 1*a*, 1*b* are synchronized with one another, that is, they are substantially equal to one another. In this embodiment, the heating devices are used as fixing devices for the toner.

Figure 11:
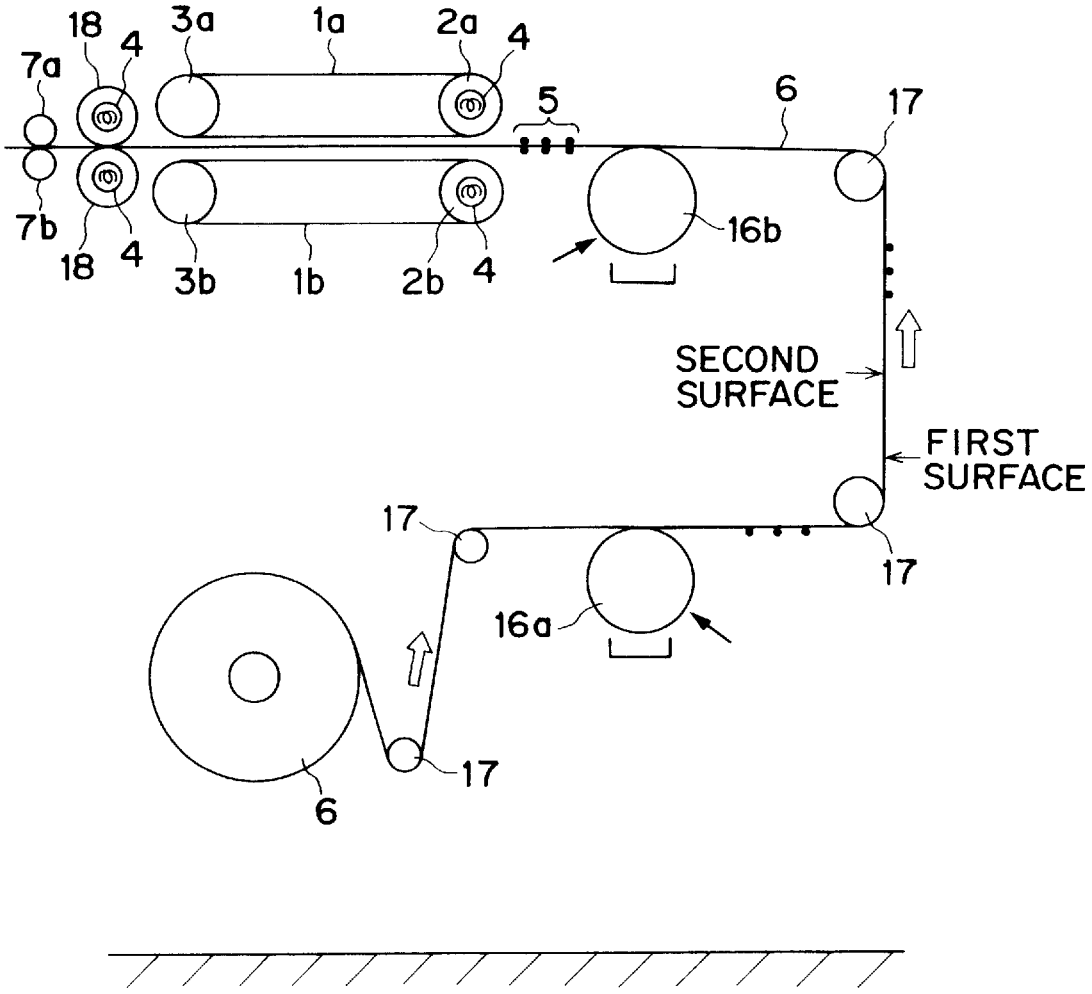
FIG. 11 is a schematic side view illustrating a recording apparatus using the heating device according to the present invention.

Next, explanation will be made of an embodiment in the heating devices according to the present invention are used as preheating devices for the recording sheet 6 and the toner 5 with reference to FIG. 11. The arrangement in this embodiment is the same as that in the forth embodiment, except that a pair of fixing rollers 18 each provided therein with a halogen lamp as a heat source are arranged, for holding both surfaces of the recording sheet 6 to be conveyed, between the heating devices and the recording sheet conveying rollers 7*a*, 7*b*.

The conveying path for the recording sheet 6, the developing and image-transferring process for the first and second surface sides of the recording sheet 6 and the like carried out until the recording sheet is conveyed up to the heating devices, are similar to those in the apparatus shown in FIG. 10. In this embodiment, the heating devices are used as the devices for preheating the toner, so that the fixing rollers 18 each provided therein with the halogen lamp 4 serving as a heat source are arranged in the vicinity of the outlets of the heating devices in order to finally fix the toner 5. The fixing rollers 18 in a pair are laid facing the recording sheet 6, for fixing toner images formed on both surfaces of the recording sheet 6, and the recording sheet 6 after fixing is conveyed by the recording sheet conveying rollers 7*a*, 7*b*. With this arrangement, the size of the fixing unit including the heating devices and the fixing rollers can be made to be smaller than that of the one which is composed of only the movable heat sources.

Figure 12:
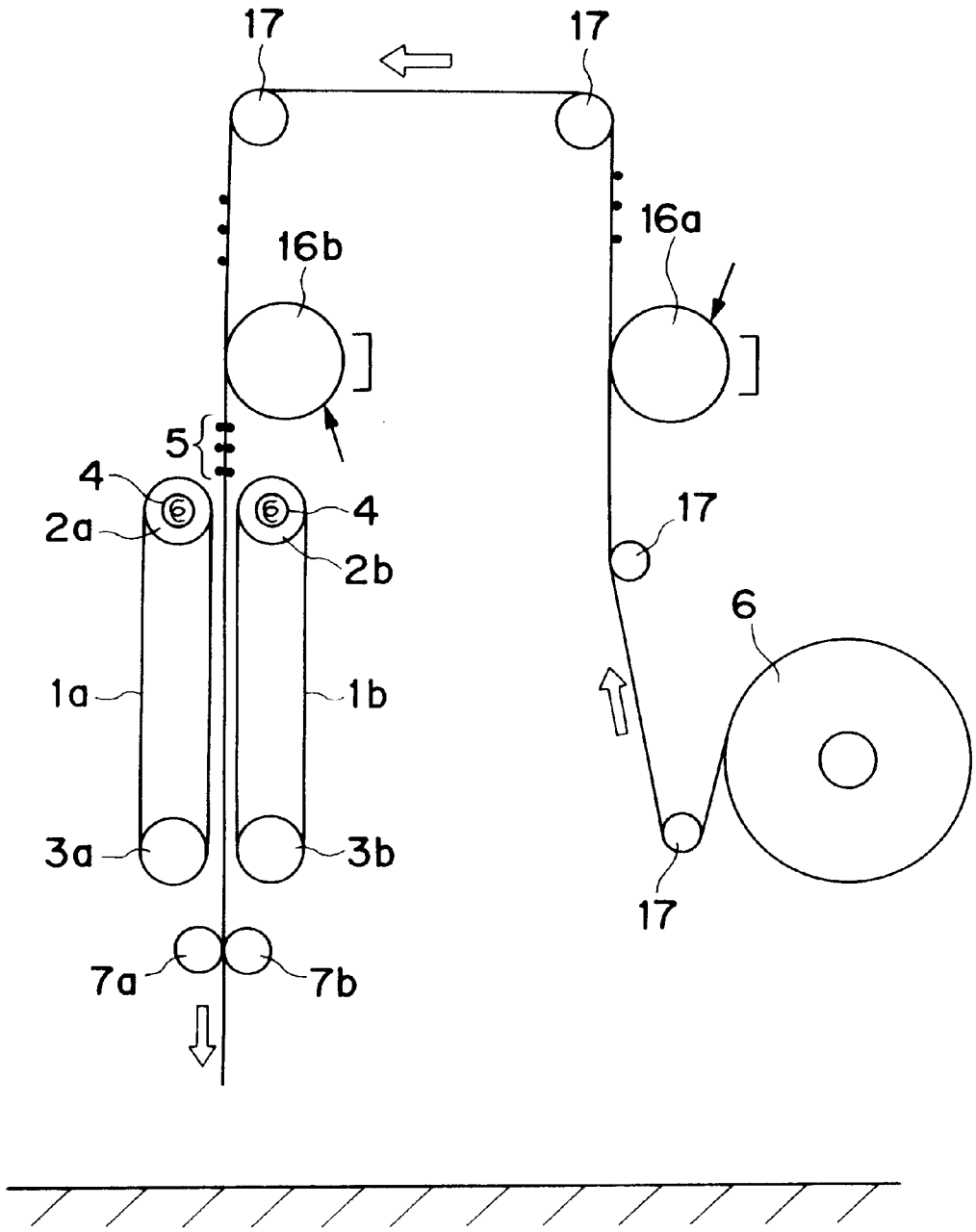
FIG. 12 is a schematic side view illustrating a recording apparatus using the heating device according to the present invention.
Figure 13:
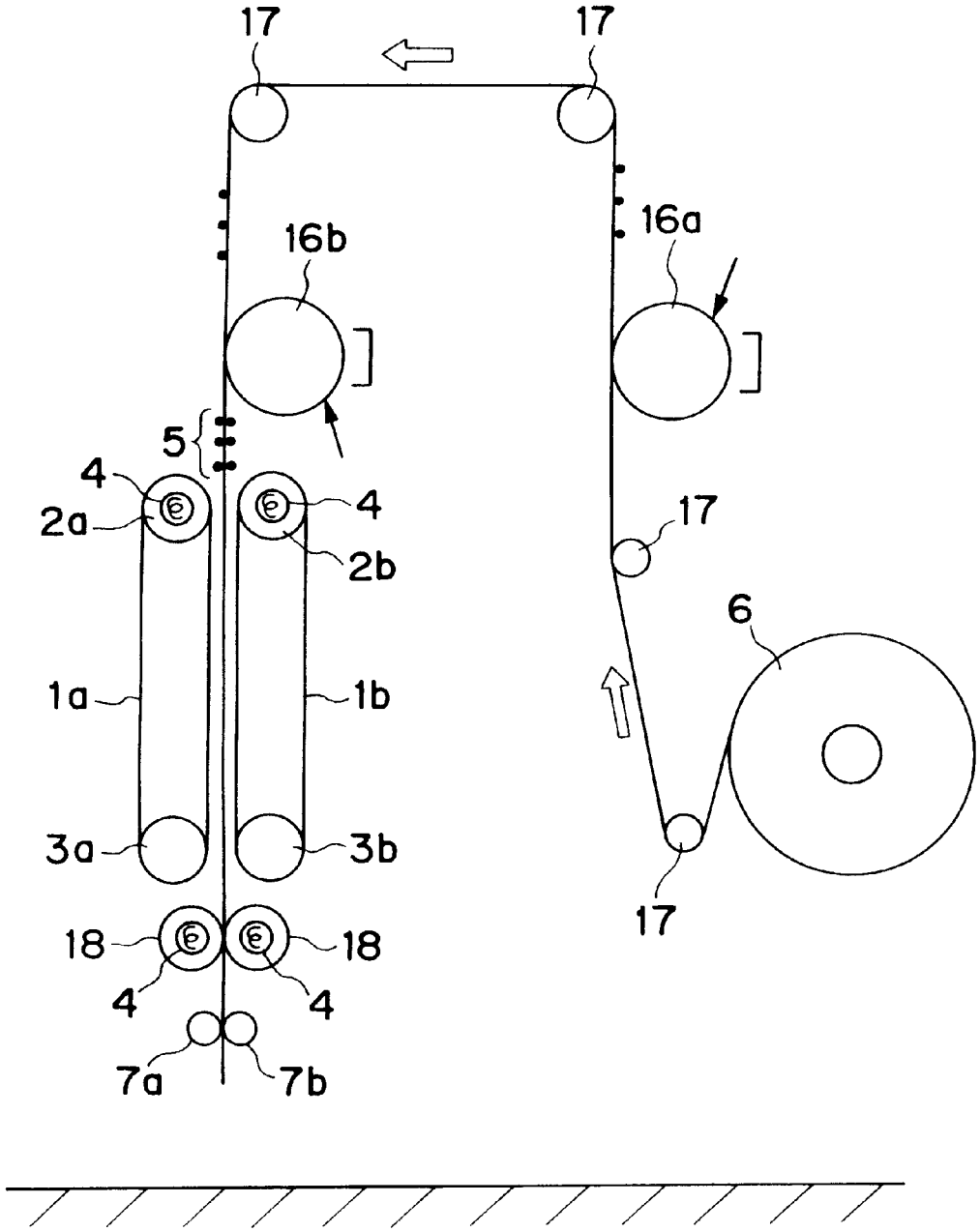
FIG. 13 is a sectional view illustrating a recording apparatus using the heating device according to the present invention.

FIGS. 12 and 13 show an example in which the conveying path between the heating devices according to the present invention is laid in a direction perpendicular to a floor surface. With this arrangement, the recording sheet 6 can be conveyed in the gravitational direction between the heating devices so that no slacking is caused in the recording sheet 6 which can therefore be stably conveyed.

Further, with this arrangement, the halogen lamps 4 which are attached in the belt drive rollers 2*a*, 2*b* shown in FIGS. 12 and 13, are attached in the idler rollers 3*a*, 3*b* in the vicinity of the floor surface, and accordingly, heat which has been radiated as a loss to the atmosphere from the heating belts 1*a*, 1*b* in parts which do not make contact with the idler belts 3*a*, 3*b* can be effectively used.

Figure 14:
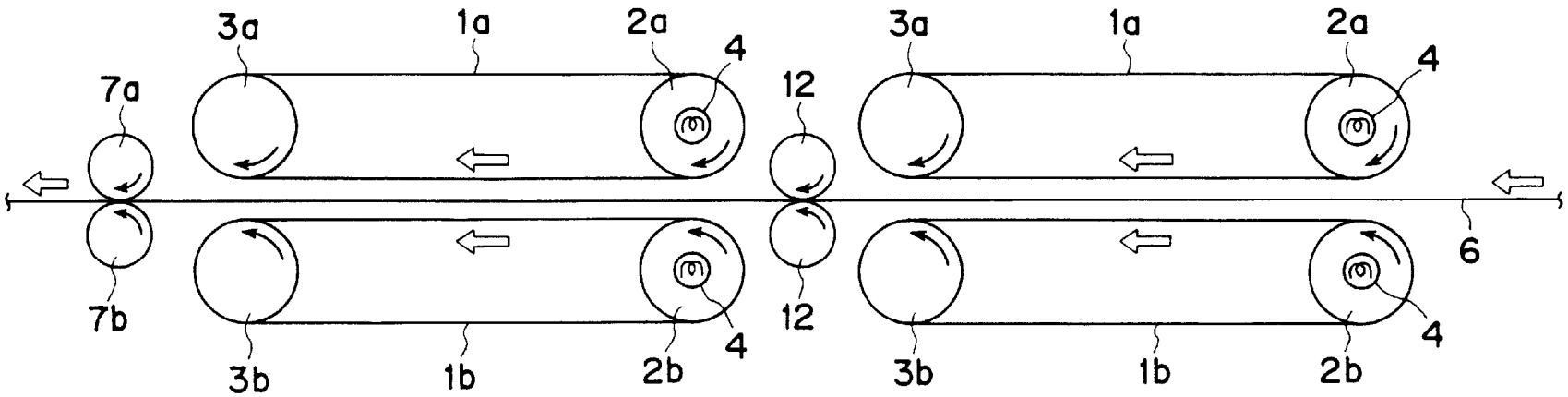
FIG. 14 is a sectional view illustrating a recording apparatus using the heating device according to the present invention.

Finally, explanation will be made of an embodiment in which the heating devices according to the present invention are arranged at a plurality n of stages with reference to FIG. 14. In this arrangement, the heating devices are laid at two stages. The heating devices are arranged facing the recording sheet 6 as mentioned above, and the recording sheet 6 is conveyed by the recording sheet conveying rollers 7*a*, 7*b*. The recording sheet conveying rolls 12 are arranged between the heating devices at the first stage and the heating devices at the second stage so as to hold the widthwise opposite end parts of the recording sheet 6. Such heating devices are used at a number n of stages so as to shorten the recording sheet conveying path between each pair of the heating devices, and accordingly, the distance by which the recording sheet 6 can be moved with no restraint, orthogonal to the conveying direction, can be shortened, thereby it is possible to stably convey the recording sheet 6. Further, if the conveying path is laid, perpendicular to the floor surface, as shown in FIGS. 12 and 13, the recording sheet conveying rolls 12 can be eliminated. In this case, the efficiency can be improved by shortening the distance between the heating devices.

Further, with the double surface image recording apparatus using the heating devices according to the present invention, the recording sheet after fixing can be conveyed only by the recording sheet conveying rollers, and accordingly, no provision of a plurality of conveying drive rollers is required in the conveying path. Thus, no complicated control for the speeds of the conveying rollers is required, and accordingly, the degree of accuracy for conveyance of the recording sheet can be enhanced, and further, the cost can be lowered.

With such an arrangement that a medium to be heated is heated by the heating belts which are laid in the vicinity of the medium to be heated, facing the latter while moving in synchronization with the medium to be heated, and that the conveying speeds are set so as V1=V2=V3 where V1 is the conveying speed of the medium to be heated, and V2 and V3 are the moving speeds of the heating belts, respectively, the thermal efficiency can be enhanced in comparison with the oven type heating device in which the heating means are stationary (V2=V3=0), and accordingly, the medium to be heated can be conveyed at a high speed. Further, since the heating devices can heat the medium to be heated, basically in a noncontact manner, no deterioration of the image quality occurs in such a case that they are used in the fixing unit, and rather, the image quality can be enhanced. In the case of heating a single surface of the recording sheet, V1=V2 (or V3) are set.

What is claimed is:

1. A recording apparatus comprising a first image forming means for forming an unfixed toner image on a first surface of a recording sheet, a second image forming means for forming an unfixed toner image on a second surface of the recording sheet, heating means composed of at least one pair of opposed belts facing said first and second surfaces of the recording sheet with gaps therebetween, respectively, and adapted to be moved in a direction in which a conveying path for the recording sheet is laid, and conveying rollers for conveying the recording sheet from the first and second image forming means to the heating means in parallel with said at least one pair of opposed belts, said gaps being set so as to cause air in said gaps to move along with said at least one pair of opposed belts and said recording sheet in the conveying direction.

2. A recording apparatus as set forth in claim 1, wherein a heating roller for heating and pressing the recording sheet is provided downstream of the heating means in which the recording sheet is conveyed.

3. A recording apparatus as set forth in claim 1, wherein said at least one pair of opposed belts is held by a plurality of rotary members, and a heat source is provided for heating at least one of said rotary members.

4. A recording apparatus as set forth in claim 1, wherein said recording sheet is moved from a paper roll.

5. A recording apparatus as set forth in claim 1, wherein said at least one pair of opposed belts and said recording sheet are fed at synchronized speeds.

6. A recording apparatus as set forth in claim 1, wherein support members for supporting opposite sides of said recording sheet are provided between said at least one pair of opposed belts.

* * * * *